US007555984B2

(12) United States Patent
Iwamoto

(10) Patent No.: US 7,555,984 B2
(45) Date of Patent: Jul. 7, 2009

(54) WEB OFFSET PRESS, AND METHOD AND APPARATUS FOR REPLACING PRINTING PLATE IN WEB OFFSET PRESS

(75) Inventor: Torao Iwamoto, Horishima-ken (JP)

(73) Assignee: Mitsubishi Heavy Industries Ltd., Tokyo (JP)

( * ) Notice: Subject to any disclaimer, the term of this patent is extended or adjusted under 35 U.S.C. 154(b) by 100 days.

(21) Appl. No.: 11/858,300

(22) Filed: Sep. 20, 2007

(65) Prior Publication Data

US 2008/0078298 A1 Apr. 3, 2008

(30) Foreign Application Priority Data

Oct. 3, 2006 (JP) ..... 2006-271790

(51) Int. Cl.
*B41F 27/12* (2006.01)
*B41F 33/00* (2006.01)

(52) U.S. Cl. ..... 101/477; 101/480; 101/219

(58) Field of Classification Search ..... 101/477, 101/479, 480, 216, 219
See application file for complete search history.

(56) References Cited

U.S. PATENT DOCUMENTS

2009/0038494 A1* 2/2009 Bernard et al. ..... 101/477

FOREIGN PATENT DOCUMENTS

JP 11198341 A 7/1999
JP 2001315295 A 11/2001
JP 2002029023 A 1/2002

* cited by examiner

*Primary Examiner*—Leslie J Evanisko
(74) *Attorney, Agent, or Firm*—Kanesaka Berner & Partners

(57) ABSTRACT

A method and apparatus for replacing a printing plate enabling to easily replace the printing plate of a plate cylinder of a printing unit in an easy posture in a variable cutoff rotary press of a web offset press or the like is realized. Upon replacing the printing plate wound around a plate cylinder by using a scaffold installed between a plurality of printing units 05*a* through 05*d* disposed at an interval along a travel path of a web, the method includes a step of dividing a part of the scaffold on a side where work for replacing the printing plate is performed, and constructing the divided scaffold to be capable of being raised and lowered, forming a released web area of the web 11 in a region from an in-feed section 04 to a dryer section 07 by forming a clearance between blanket cylinders 17*a* and 17*b* for nipping the web from both sides in the printing unit, a step of lowering the divided scaffold to a position adapted for the work for replacing the printing plate of an upper plate cylinder 15*a* while pressing down the web with a lower surface of the divided scaffold by utilizing a sag of the web in the released web area, and a step of performing the work for replacing the printing plate of the upper plate cylinder by using the divided scaffold.

9 Claims, 10 Drawing Sheets

WEB OFFSET PRESS, AND METHOD AND APPARATUS FOR REPLACING PRINTING PLATE IN WEB OFFSET PRESS

RELATED APPLICATIONS

The present application is based on, and claims priority from, Japanese Application Number 2006-271790, filed Oct. 3, 2006, the disclosure of which is hereby incorporated by reference herein in its entirety.

BACKGROUND OF THE INVENTION

1. Field of the Invention

The present invention relates to a web offset press, and more particularly to a method and an apparatus for replacing a printing plate, which enables a worker to easily replace the printing plate by using a scaffold installed between printing units in a case that the printing plate of a plate cylinder provided in the printing unit in a variable cutoff rotary press where a diameter of the plate cylinder is able to be changed is replaced.

2. Description of the Related Art

A printing section of a web offset press is composed of a plurality of printing units, and in each of the printing units, an upper blanket cylinder and an upper plate cylinder are provided at an upper part of a web, and a lower blanket cylinder and a lower plate cylinder are provided at a lower part of the web while sandwiching the web. A picture on a printing plate wound around the upper plate cylinder is transferred onto an upper surface of the web via the upper blanket cylinder, and a picture on a printing plate wound around the lower plate cylinder is transferred onto a lower surface of the web via the lower blanket cylinder.

Each of the printing units is that for printing a cyan, yellow, magenta, and black, respectively, and by utilizing a color mixture thereof, a color printing is achieved. A scaffold is installed between printing units adjacent to each other at a height of approximately a chest of humans, and a worker performs an exchange of ink, maintenance for a group of various kinds of rollers, and a work for replacing a printing plate while climbing up the scaffold.

As a scaffold device for maintenance and repair, for use in the printing press, for example, a step device installed between printing units in a multicolor press or the like is disclosed in the Unexamined Japanese Patent Application Publication No. 11-198341. Further, in the Unexamined Japanese Patent Application Publication No. 2001-315295, a scaffold device where a step plate is enabled to be raised and lowered by means of a lifting and lowering device such as a pantograph mechanism or the like is disclosed. Furthermore, in the Unexamined Japanese Patent Application Publication No. 2002-29023, a scaffold device, which is movable between a working position and a waiting position for a printing unit, and is disposed at a position where a moving trajectory thereof does not interfere an apparatus for replacing a printing plate is disclosed.

In such a conventional web offset press as described above, the work for replacing a printing plate wound around a plate cylinder is performed in the following procedure, in which one end of the printing plate is removed first, the printing plate is removed while rotating the plate cylinder in one rotation, and finally another end is removed. Next, a new printing plate is attached in a reverse procedure to that of removing the printing plate while rotating the plate cylinder in one rotation.

Although such work for replacing the printing plate is performed by using the scaffold installed between printing units for the upper plate cylinder, specifically, in a case of a variable cutoff rotary press where a diameter of the plate cylinder is able to be changed, since a device for enabling to change the diameter of the plate cylinder or the like is installed, a distance between the scaffold and the upper plate cylinder is large and a place at a height of the upper plate cylinder is located at a position close to an upper surface of the scaffold for a structural reason. Hence, in a case that a worker replaces the printing plate of the upper plate cylinder, the worker has been obliged to perform such work as removing an old printing plate from, and replacing a new printing plate to the plate cylinder located at a place at a height near a level of a foot with an extraordinary difficulty in a labored posture in an unnatural posture while hunkering down and stretching. Therefore, accuracy of attaching the printing plate becomes unstable, and it has been taking much time for replacing the printing plate. However, any of a device or a method for solving such work is not disclosed in the Unexamined Japanese Patent Application Publication Nos. 11-198341, 2001-315295, and 2002-29023.

Even when the scaffold is intended to be disposed at a relatively lower position so that the aforementioned work is improved, the scaffold cannot be disposed at the relatively lower position because a travel path of the web (web path line) is located below the scaffold and thereby it is possible for the scaffold to be brought into contact with the web. Since the web between the printing units is in a process of just after printed by means of the printing unit, the ink on the web has not been dried yet, and therefore elements other than blanket cylinders are avoided to contact the web between each of the printing units. On the other hand, as for the work for replacing the printing plate of the lower plate cylinder, there is no necessity for the worker to ride on the scaffold hung between printing units and the work for replacing the printing plate can be performed in a relatively easy posture on a step provided on a floor surface.

SUMMARY OF THE INVENTION

In consideration of the above-described problems of the conventional technology, it is an object of the present invention to realize a method and apparatus for replacing a printing plate of an upper plate cylinder in a printing unit of a web offset press in an easy posture and in an accurate fashion with high dimensional accuracy.

In order to achieve the above-described object, the first invention relating to a printing plate replacing method, according to the present invention, is a printing plate replacing method in a web offset press for replacing a printing plate wound around a plate cylinder by using a scaffold installed between a plurality of printing units disposed at an interval along a travel path of a web, which includes the steps of dividing a part of a scaffold on a side where work for replacing the printing plate is performed, and disposing the divided scaffold above the travel path of the web in a manner capable of being raised and lowered, forming a released web area in a region from an in-feed section to a dryer section via a plurality of the printing units by forming a clearance between blanket cylinders nipping the web from both sides in the printing unit, lowering the divided scaffold to a position adapted for the work for replacing the printing plate of the upper plate cylinder while pressing down the web with a lower surface of the divided scaffold by utilizing a sag of the web in the released web area, and subsequently performing the work for replacing the printing plate of the upper plate cylinder by using the divided scaffold.

Further, the first invention with respect to a printing plate replacing apparatus, for implementing the aforementioned first invention with respect to the printing plate replacing method, is a printing plate replacing apparatus in a web offset press for installing a scaffold between a plurality of printing units disposed at an interval along a travel path of a web and replacing a printing plate wound around a plate cylinder by using the scaffold, which includes the scaffold being disposed above the travel path of the web, and a part of the scaffold on a side where work for replacing the printing plate is performed being divided and constructed to be capable of being raised and lowered in an up-and-down direction, means for forming a released web area in a region from an in-feed section to a dryer section via the plurality of printing units by forming a clearance between blanket cylinders nipping the web from both sides in the printing unit, and means for elevating the scaffold for lowering the divided scaffold while pressing down the web with a lower surface of the divided scaffold by utilizing a sag of the web in the released web area upon replacing the printing plate, and for raising the scaffold to a former position after completing the work for replacing the printing plate.

In the first invention with respect to the method and apparatus for replacing the printing plate, a part of the scaffold installed between the printing units on a side where the work for replacing the printing plate is performed is divided, and the divided part is disposed above the travel path of the web in a manner capable of being raised and lowered.

In a case that the work for replacing the printing plate is performed upon constructing as described above, the released web area where there is no nipped portion of the web in the region from the in-feed section to the dryer section via the plurality of printing units is formed by forming the clearance between the blanket cylinders nipping the web from both sides in the printing unit.

In the released web area, since there is no portion where the web is nipped, a sag of the web is formed. The sag of the web over an entire released web area is concentrated on the divided scaffold by gradually pressing down the web with the lower surface of the divided scaffold by utilizing the sag of the web.

While gradually pressing down the web with the divided scaffold, the divided scaffold is lowered to a position adapted for the work for replacing the printing plate of the upper plate cylinder. Hence, there is no possibility to produce an excessive tension force for the web and to damage or break the web. When the divided scaffold is lowered to a position appropriate for the work for replacing the printing plate, a worker performs the work for replacing the printing plate of the upper plate cylinder while riding on the divided scaffold.

Since the scaffold, a part of which is divided, is raised and lowered in the first invention, if a lowering amount of the divided scaffold is suppressed to be relatively small, the scaffold can be lowered to the position where the work for replacing the printing plate can be performed in the easy posture by only utilizing an amount of the sag produced in the released web area even when the web is not forwarded from a paper feed section or the in-feed section.

Thus, in the first invention, since a part of the scaffold installed between the printing units on the side where the work for replacing the printing plate is performed is divided and constructed to be capable of being raised and lowered, and in addition, the same is lowered by a relatively short distance sufficient for replacing the printing plate in the easy posture for the worker, a sag sufficient for lowering the divided scaffold in the released web area can be held by forming the released web area where there is no nipped portion of the web in the area from the in-feed section to the dryer section via the printing units. If the sag held in the released web area is concentrated in the printing unit where the work for replacing the printing plate is performed, the divided scaffold can be lowered to the position where the work for replacing the printing plate can be performed in the easy posture.

The second invention with respect to a printing plate replacing method, according to the present invention, is a printing plate replacing method in a web offset press for replacing a printing plate wound around a plate cylinder by using a scaffold installed between a plurality of printing units disposed at an interval along a travel path of a web, which includes the steps of disposing the scaffold above a travel path of the web in a manner capable of being raised and lowered in replacing the printing plate, forming an released web area in a region from an in-feed section to a dryer section via the plurality of printing units by forming a clearance between blanket cylinders nipping the web from both sides in the printing unit, producing a sag of the web in the region from the in-feed section to the dryer section via the plurality of printing units by feeding the web in a paper feed section or the in-feed section, lowering the scaffold to a vicinity of a lowest position while pressing down the web with a lower surface of the scaffold by utilizing the sag of the web, and subsequently replacing the printing plate of an upper plate cylinder on the scaffold.

Furthermore, the second invention with respect to a printing plate replacing apparatus, for implementing the second invention with respect to the printing plate replacing method, is a printing plate replacing apparatus in a web offset press for installing a scaffold between a plurality of printing units disposed at an interval along a travel path of a web and replacing a printing plate wound around a plate cylinder by using the scaffold, which includes the scaffold being disposed above the travel path of the web in a manner capable of being raised and lowered, means for forming a released web area in a region from the in-feed section to the dryer section via the plurality of printing units by forming a clearance between blanket cylinders nipping the web from both sides in the printing units, means for reducing a tension of the web for producing a sag of the web in the released web area by feeding the web in a paper feed section or the in-feed section, and means for elevaing the scaffold for lowering the scaffold while pressing down the web with a lower surface of the scaffold by utilizing the sag of the web upon replacing the printing plate, and for raising the scaffold to a former position after completing the work for replacing the printing plate.

In the second invention with respect to the method and apparatus for replacing the printing plate, the nip of the web is released by forming the clearance between the blanket cylinders nipping the web in the printing units first, and the released web area is formed in the region from the in-feed section to the dryer section via the plurality of printing units.

Next, the sag of the web is produced in the released web area by feeding the web in the paper feed section or the in-feed section. Thereby, even when the lowering amount of the elevating scaffold is increased, a sufficient amount of the sag of the web capable of following the same can be produced and the work for replacing the printing plate can easily be performed.

Thereafter, the scaffold is lowered to the vicinity of the lowest portion while pressing down the web with a lower surface of the scaffold capable of being raised and lowered by utilizing the sag of the web, and thereafter the worker performs the work for replacing the printing plate of the upper plate cylinder by riding the scaffold.

As described above, since the web is forwarded in the paper feed section or the in-feed section in advance, the sag of the web has a sufficient elbow room even when the scaffold is lowered to the vicinity of the lowest portion, and there is no possibility to produce the excessive tension force to the web. Hence, there is no possibility to damage or break the web. Moreover, since the sag of the web has the sufficient elbow room, the scaffold can be lowered to a position close to a floor surface and thereby the worker can easily ride the scaffold without using the ladder or the like.

Thus, since the worker can perform the work for replacing the printing plate by lowering the scaffold to a position where the worker has an easy posture to perform the work for replacing the printing plate, the work for replacing the printing plate can easily be performed at a short time in an accurate fashion with high dimensional accuracy.

Incidentally, when a usual printing operation is performed after the work for replacing the printing plate is completed, it is necessary to perform a rewinding operation for the sagged web by rewinding a paper web in the paper feed section, or the like.

In the first invention or the second invention with respect to the method for replacing the printing plate, in a case that the sag of the web in the area from the in-feed section to the dryer section via the plurality of printing units is concentrated to the scaffold while guiding the web with the lower surface of the divided scaffold or the scaffold, preferably, the surface finishing or surface treating is performed for the lower surface of the divided scaffold or the scaffold where the web is brought into contact with, to form a low friction surface.

For example, an edge of the lower surface is formed to have a round chamfer or coated with a fluorinated coating agent such as Teflon (registered trade mark) or the like. Thereby, the scaffold can smoothly be raised and lowered while suppressing the friction between the lower surface of the scaffold and the web, which may cause damage, a break, or the like of the web.

Further, in the first invention and the second invention with respect to the method and apparatus for replacing the printing plate, preferably, if a guide device such as a guide roller or the like for example, is provided on the lower surface of the divided scaffold or the scaffold where the web is brought into contact with, and the web is pressed down with the lower surface of the scaffold while being guided in the traveling direction thereof by means of the guide device, similarly the scaffold can smoothly be raised and lowered while suppressing the friction caused between the lower surface of the scaffold and the web.

Furthermore, as the guide device, air may be blown into a space between the lower surface of the scaffold and the web. Thereby, the scaffold can smoothly be raised and lowered while further suppressing the friction, which may cause the damage, the break, or the like of the web.

Moreover, as a device for raising and lowering the divided scaffold or the scaffold, it is preferable to attach the divided scaffold or the scaffold to a linear guide that rises and falls along a linear rail provided on a fixed portion in an up-and-down direction, and to construct the device to be capable of being raised and lowered by means of an air cylinder provided on the fixed portion. If the device is constructed as described above, the construction of the device for raising and lowering the scaffold can be simplified, and in addition the scaffold that rises and falls can be supported at sufficient strength.

Further, the present invention is related to a web offset press provided with an apparatus for replacing the printing plate having the aforementioned construction. By being provided with the apparatus for replacing the printing plate having the aforementioned construction, a worker can perform the work for replacing the printing plate of the upper plate cylinder in an easy posture, and thereby the printing plate can be attached at a short time in an accurate fashion with high dimensional accuracy.

DETAILED DESCRIPTION OF THE PREFERRED EMBODIMENTS

Figure 1:
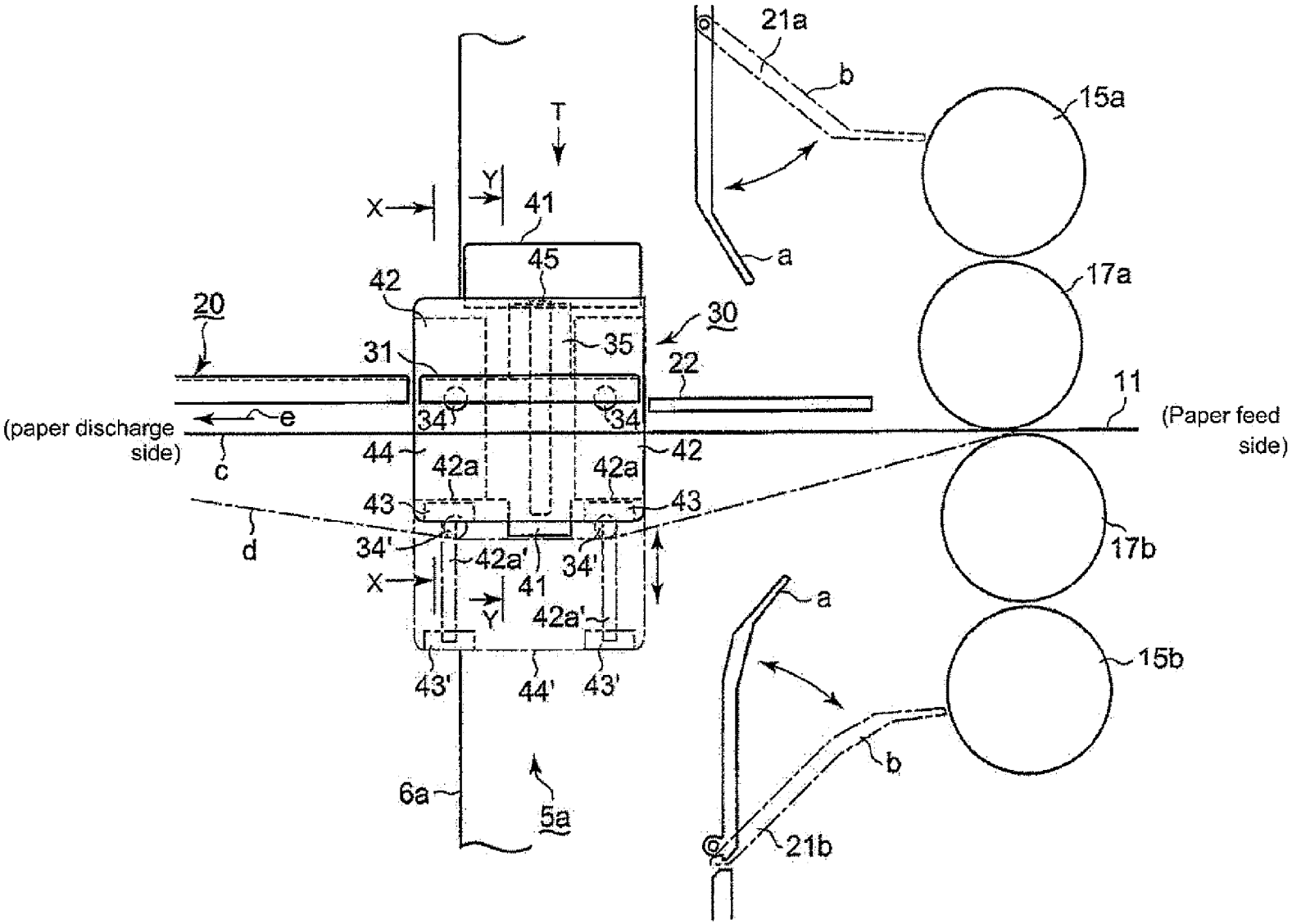
FIG. 1 is an elevation illustrating an embodiment according to a first invention of the present invention.

Hereinbelow, the present invention will be explained in detail using the embodiments illustrated in the drawings. However, the present invention is not intended to be limited only to dimensions, materials, shapes, relative dispositions or the like of the components described in the embodiment except other than specifically described.

Figure 2:
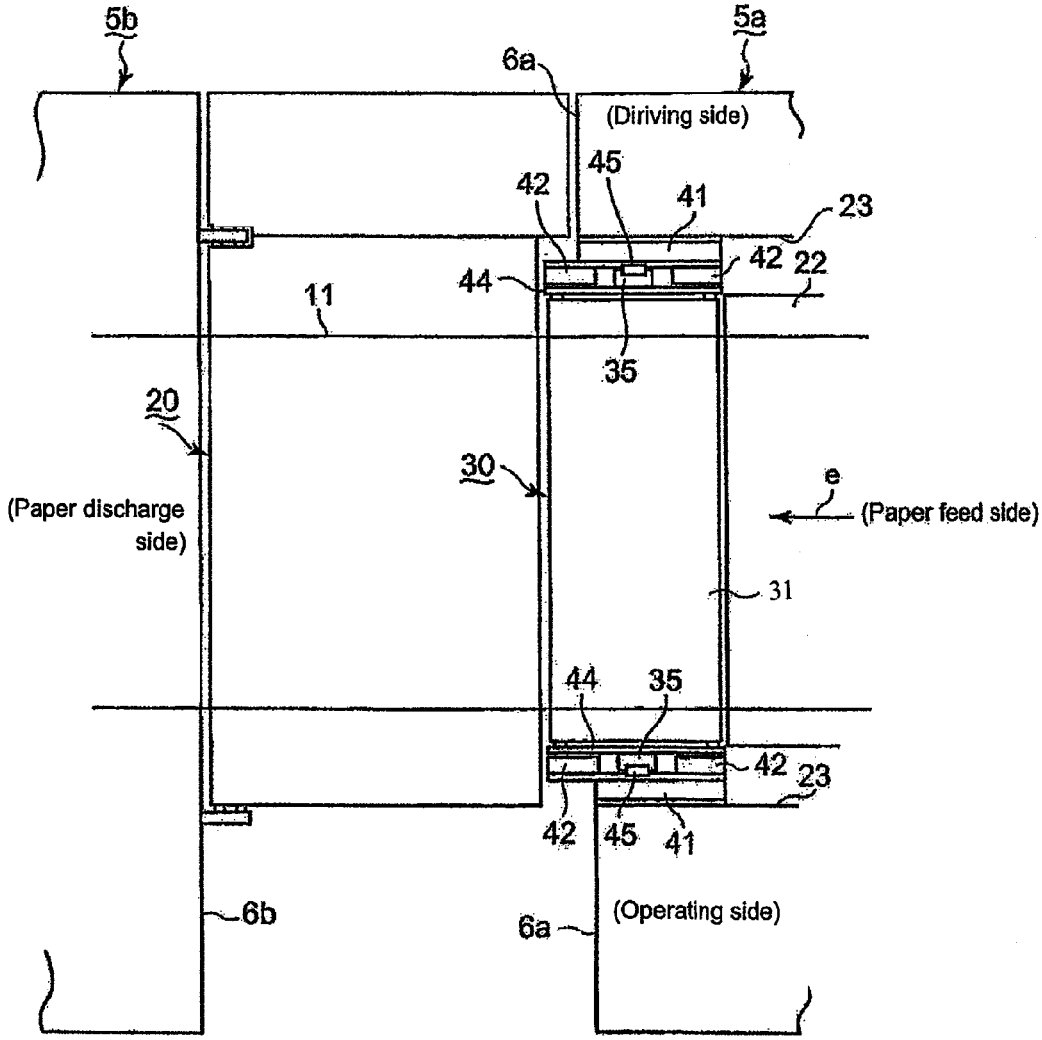
FIG. 2 is a plan view of the aforementioned embodiment.
Figure 3:
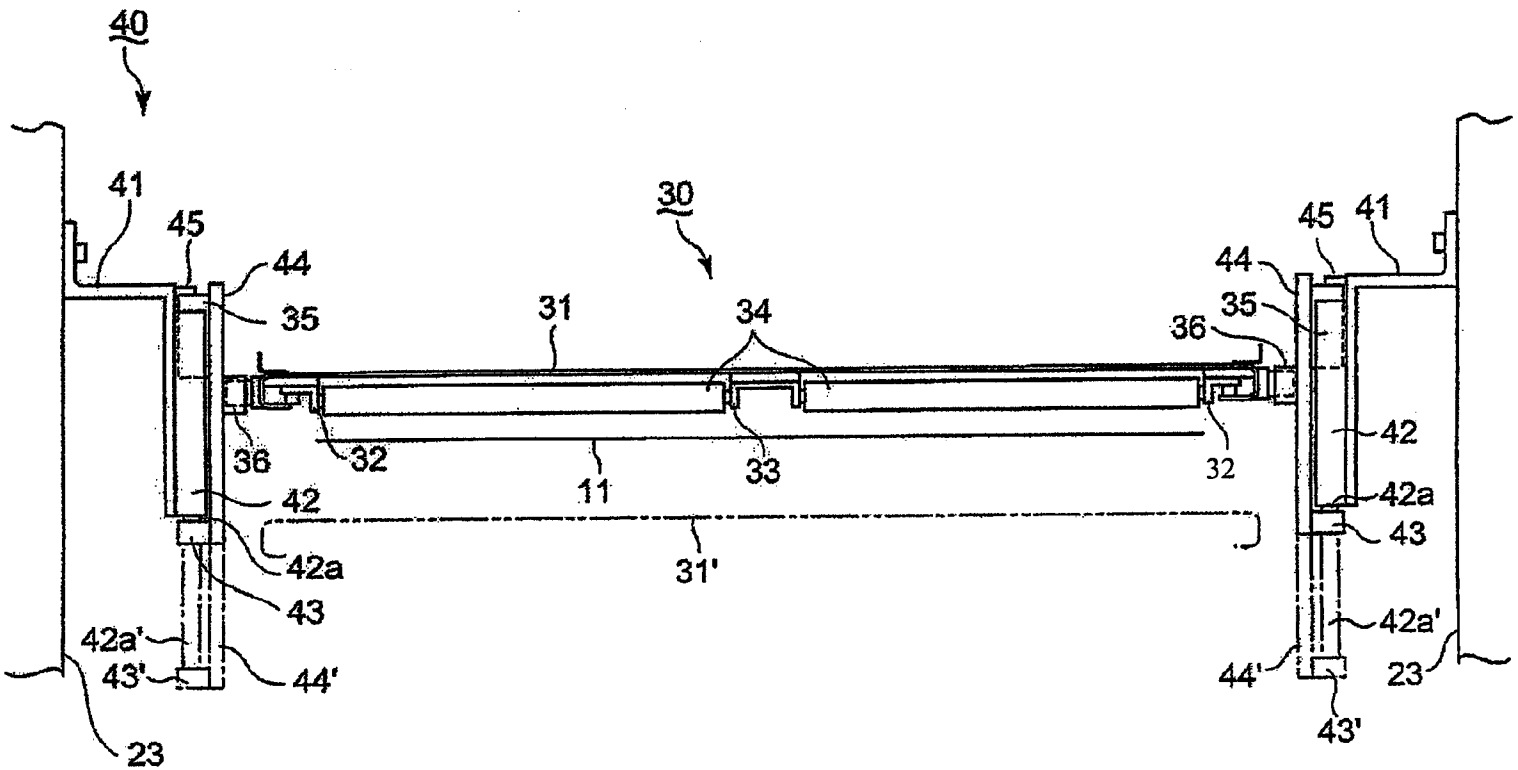
FIG. 3 is a cross-sectional view taken along a line X-X in FIG. 1.
Figure 4:
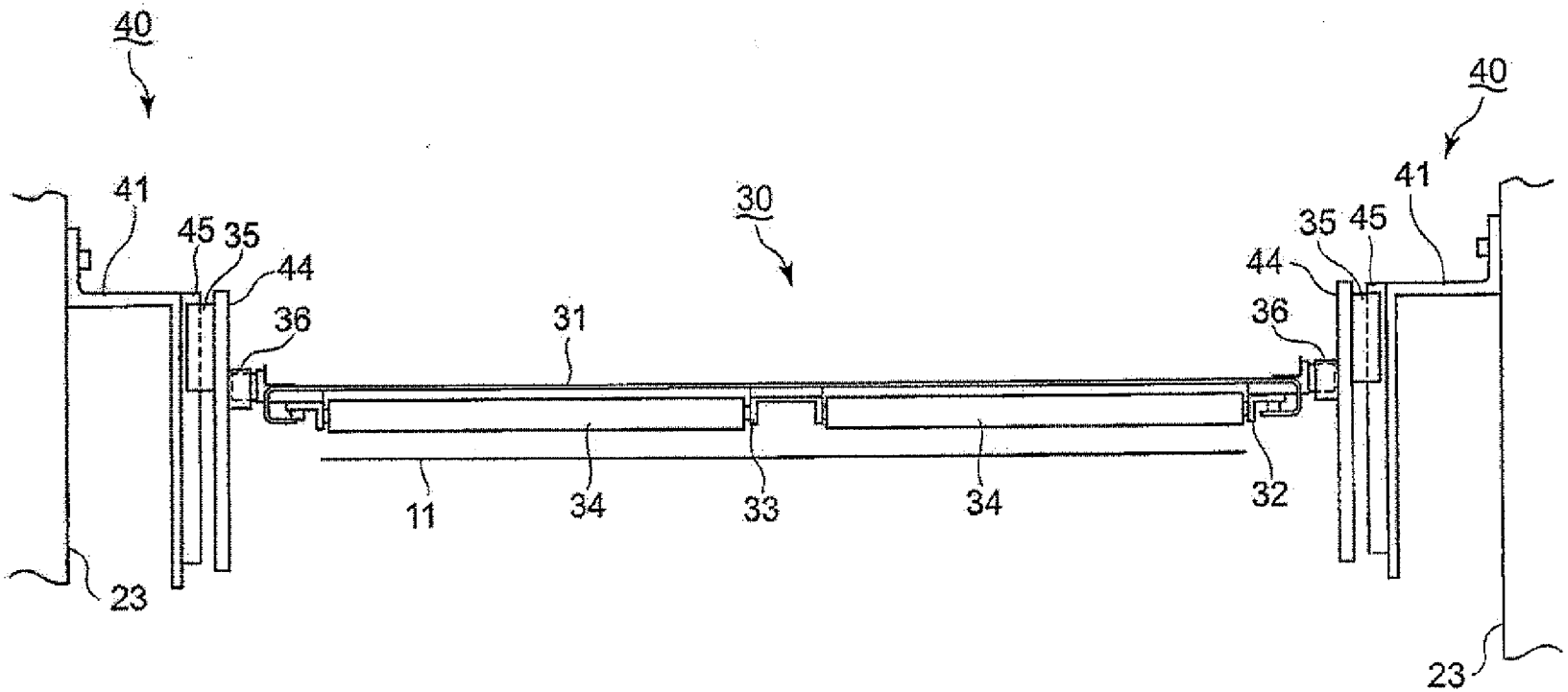
FIG. 4 is a cross-sectional view taken along a line Y-Y in FIG. 1.
Figure 5:
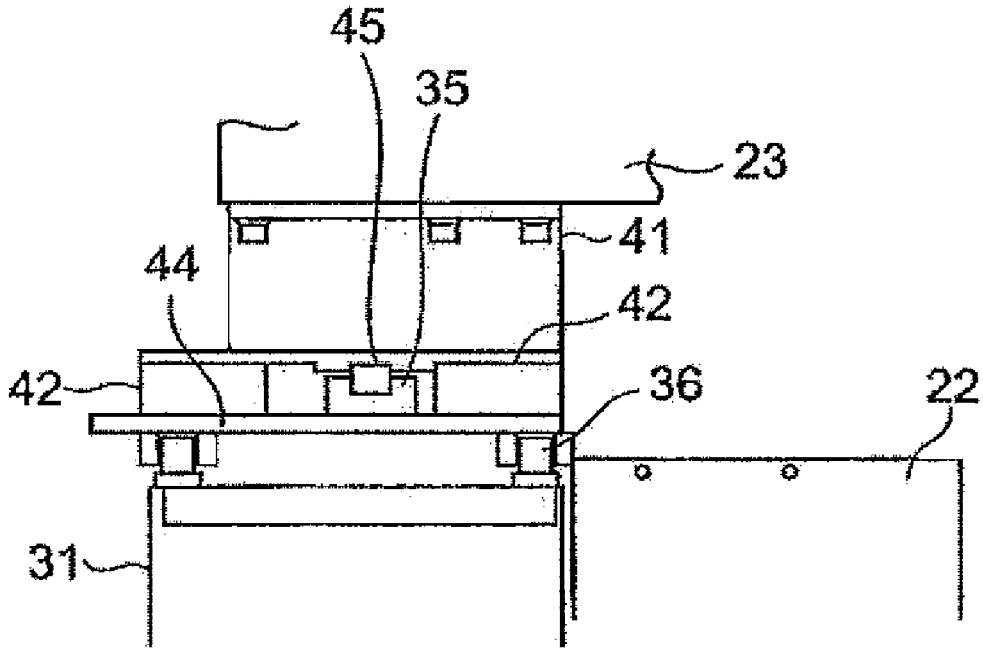
FIG. 5 is a plan view looking from a direction T in FIG. 1.

FIG. 1 is an elevation illustrating an embodiment (first embodiment) according to a first invention of the present invention, FIG. 2 is a plan view of the aforementioned first embodiment, FIG. 3 is a cross-sectional view taken along a line X-X in FIG. 1, FIG. 4 is a cross-sectional view taken along a line Y-Y in FIG. 1, and FIG. 5 is a plan view looking from a direction T in FIG. 1.

Figure 6:
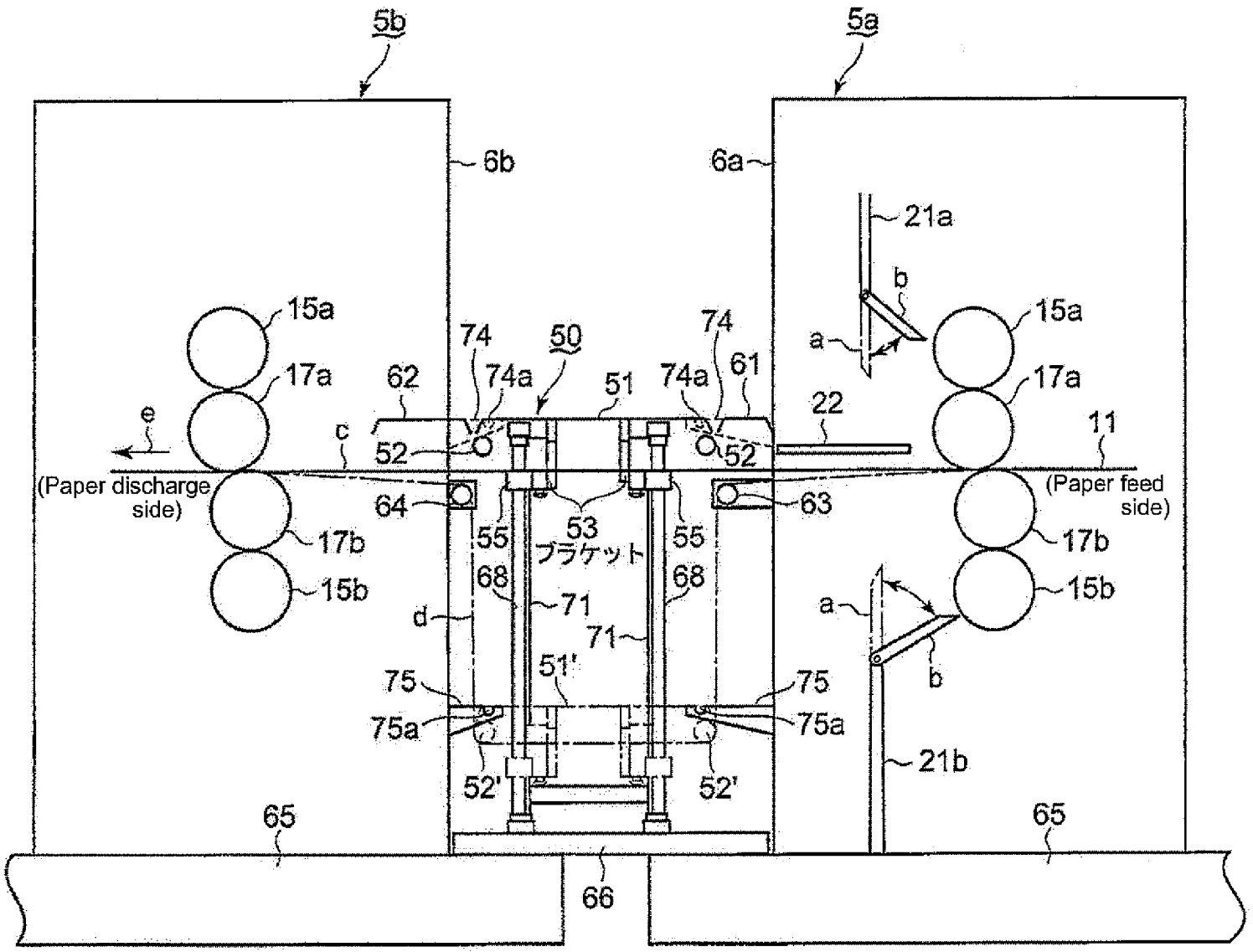
FIG. 6 is an elevation illustrating the embodiment according to the second invention of the present invention.
Figure 7:
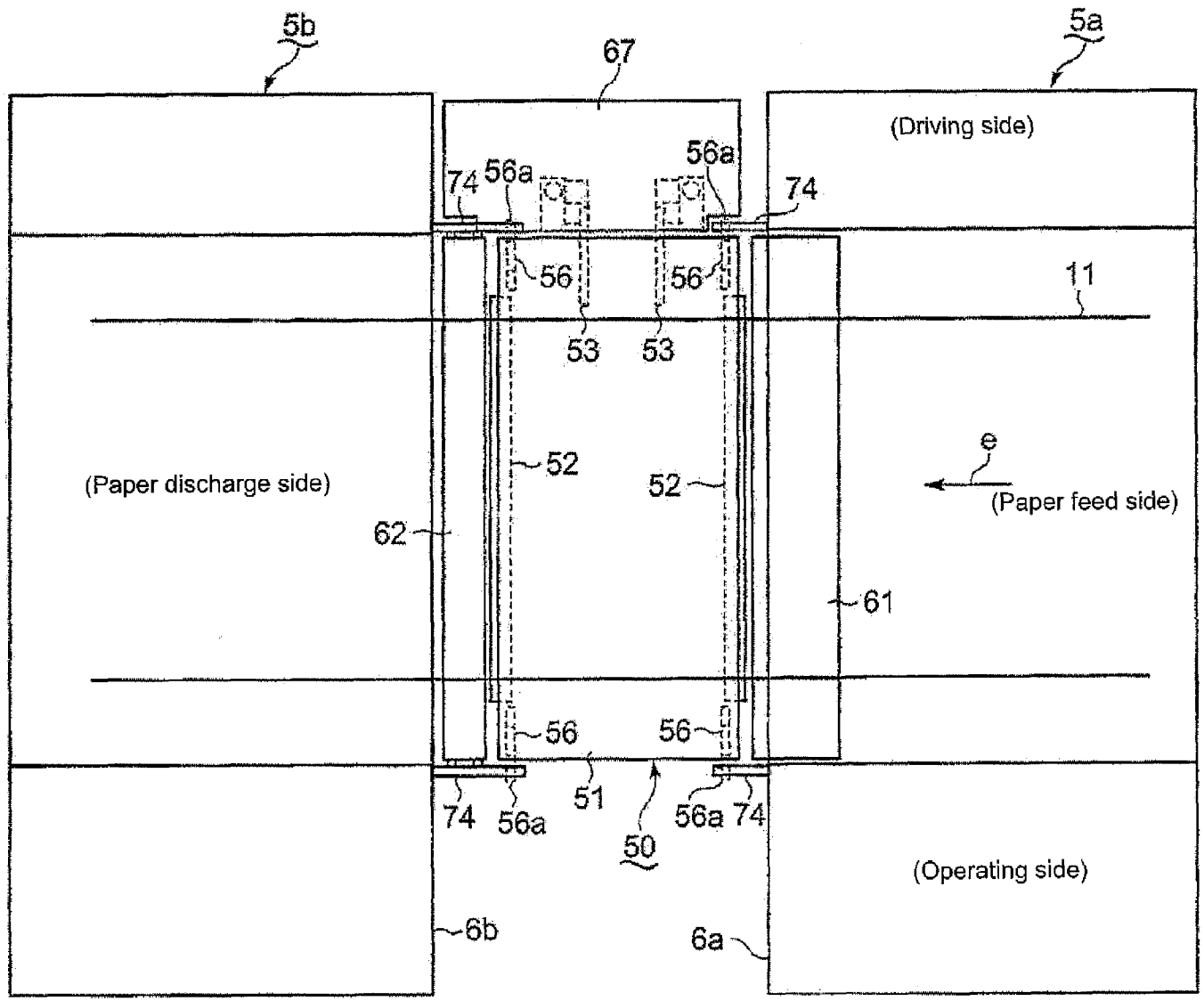
FIG. 7 is a plan view of the aforementioned embodiment.
Figure 8:
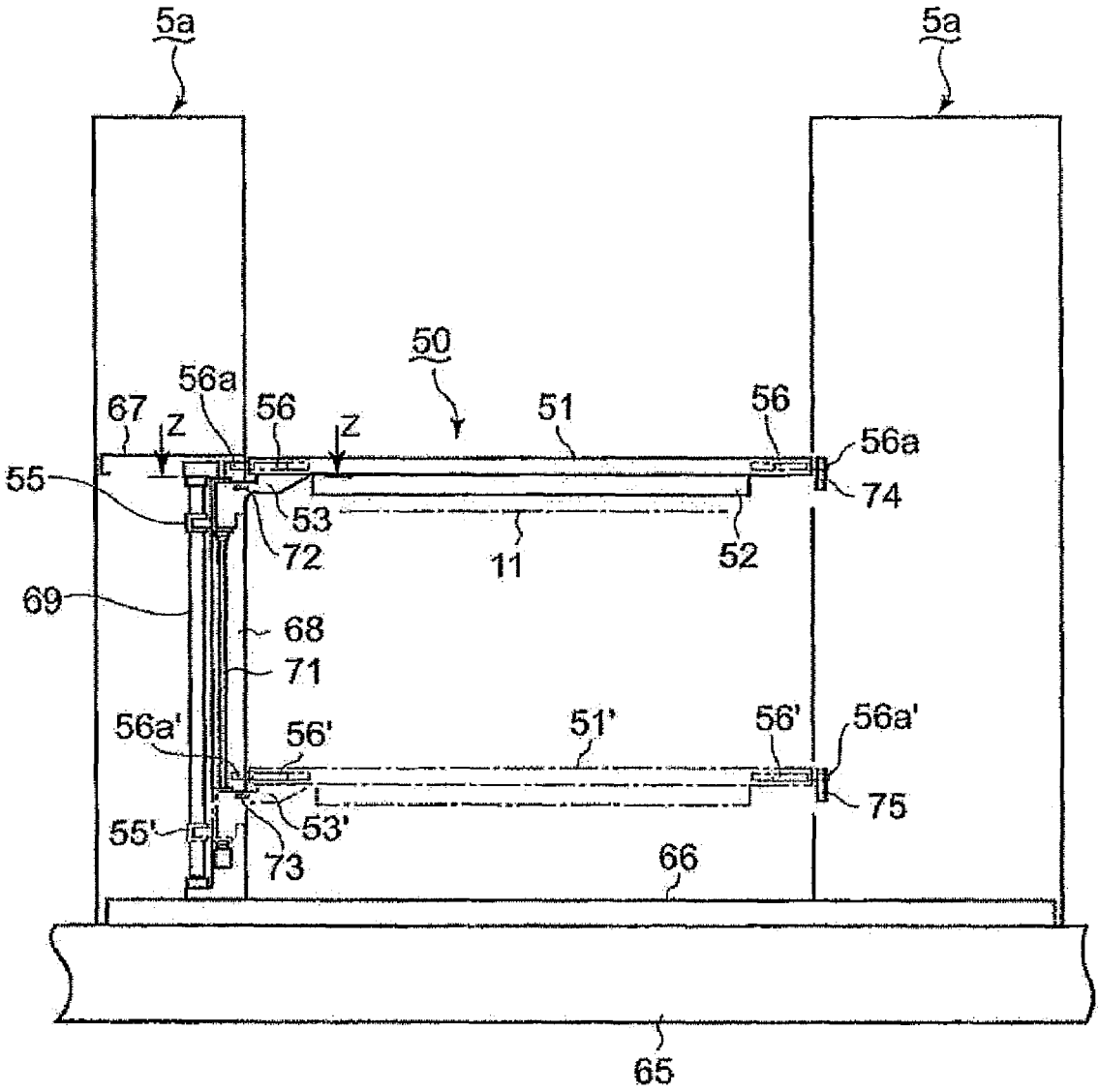
FIG. 8 is a right side view of the aforementioned embodiment.
Figure 9:
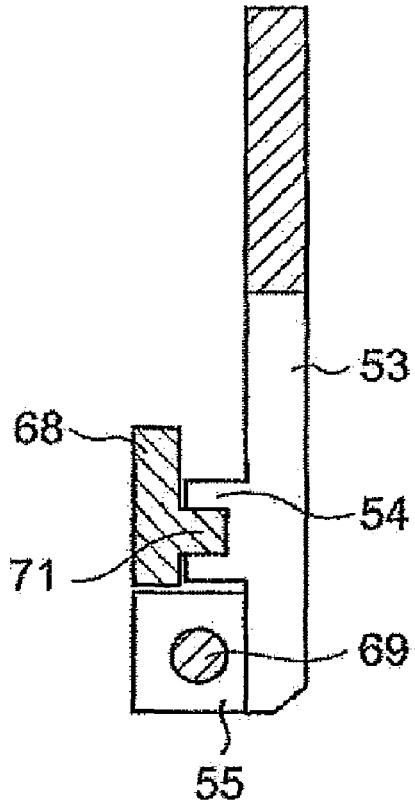
FIG. 9 is a cross-sectional view taken along a line Z-Z in FIG. 8.

FIG. 6 is an elevation illustrating the embodiment (second embodiment) according to the second invention of the present invention, FIG. 7 is a plan view of the aforementioned second embodiment, FIG. 8 is a right side view of the aforementioned second embodiment, and FIG. 9 is a cross-sectional view taken along a line Z-Z in FIG. 8.

EMBODIMENT OF THE FIRST INVENTION

In addition, in FIGS. 1, 3, 6, and 8, the same reference numerals, with or without the prime symbols attached, denote the same parts of the structure in different positions.

First, an entire construction of a web offset press will be explained using an entire explanatory view schematically illustrating a conventional ordinary web offset press of FIG. 10.

Figure 10:
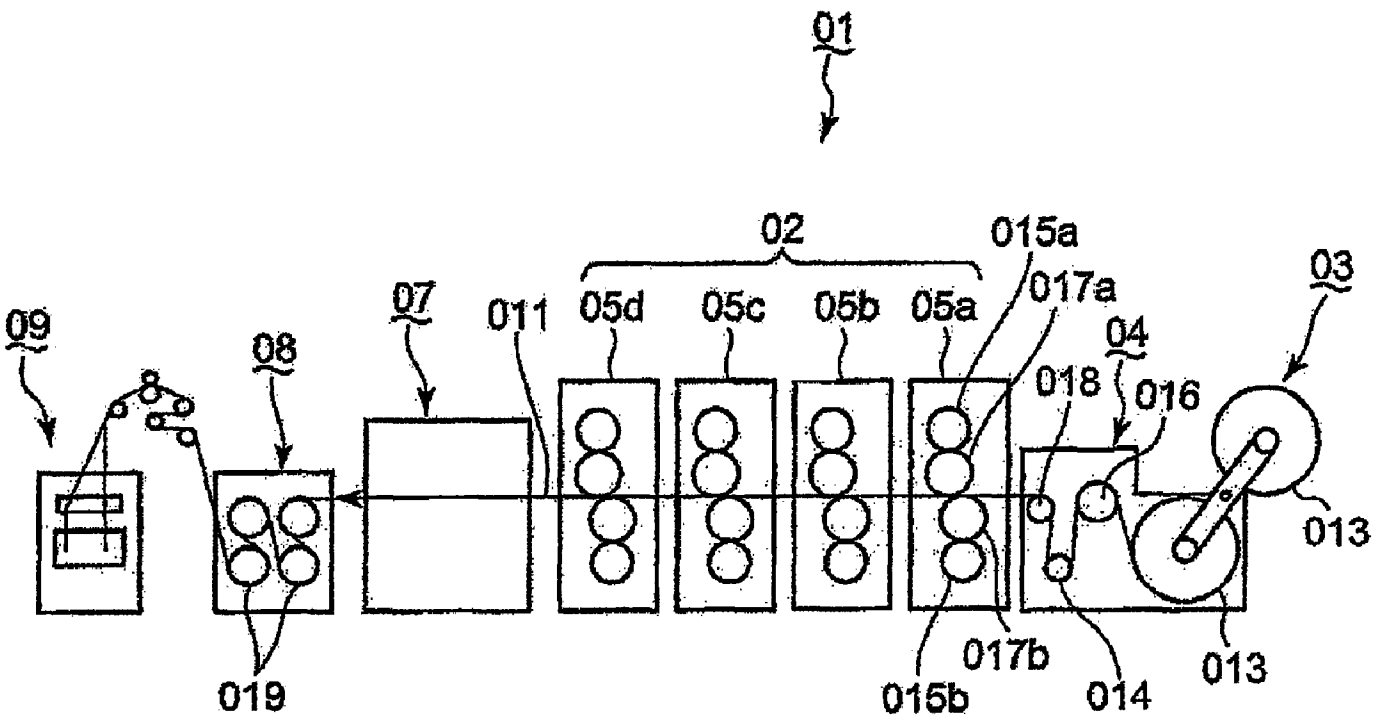
FIG.10 PRIOR ART
FIG. 10 is an entire construction view schematically illustrating a conventional ordinary web offset press.

In FIG. 10, a paper feed section 03 of a web offset press 01 has a reel stand having rolls of web offset paper 013 mounted thereon, and the reel stand functions to unreel a web 011 in a continuous fashion while connecting a new web offset paper 013 and an old web offset paper 013 to each other during the printing operation.

Further, an in-feed section 04 is a section to draw out the web 011 from the roll-shaped web offset paper 013 in a continuous fashion, and for example, is provided with a paper feed drag roll 016 for feeding the web 011 to a printing section 02, and a dancer roll 014 capable of changing a distance from the paper feed drag roll 016. A tension force applied to the web 011 is appropriately controlled by means of the dancer roll 014. Alternatively, a case in which a balance weight roller where a constant tension force is applied to the web 011 by adding a pressure by means of an air cylinder is provided is sometimes applicable as well. The web 011 in which the tension force is controlled by means of the in-feed section 04 is conveyed to the printing section 02 via a guide roller 018.

In the printing section 02, usually a plurality of sets of printing units 05*a* through 05*d* having different colors of ink are provided along a traveling direction of the web 11 and are arranged side by side, and each printing unit includes upper and lower plate cylinders 015*a* and 015*b*, and upper and lower blanket cylinders 017*a* and 017*b*. Pictures on the upper and lower plate cylinders 015*a* and 015*b* are transferred onto the web 011 via the blanket cylinders 017*a* and 017*b*, respectively. The printing section 02 is configured to achieve a multi-color printing by sequentially passing the web 011 through each of the printing units 05*a* through 05*d*.

Incidentally, a distance between the printing units is basically large, and configured to be about the same degree of width of the printing unit, and a scaffold (not illustrated) is provided between the printing units above the web 011. A worker performs an exchange operation of the ink, maintenance of a group of various kinds of rollers, and work for replacing a printing plate in each of the printing units, or the like upon climbing up the scaffold.

The web 011 printed by the printing units 05*a* through 05*d* is conveyed to a dryer section 07 and is cooled down by being conveyed to a cooling section 08 after heated and dried in the dryer section 07. The cooled web 011 is cut out and folded back in a folding section 09, formed into an intended pullout binding, and is conveyed outward.

Next, the embodiment according to the first invention of the present invention (first embodiment) will be explained on the basis of FIGS. 1 through 5. The present embodiment is an embodiment in a case that a printing plate of a printing unit 5*a* corresponding to the printing unit 05*a* in FIG. 10 in a plurality of printing units is replaced in the variable cutoff rotary press of the web offset press, and in FIGS. 1 and 2, a web 11 travels in a direction indicated by the arrow "e" from the paper feed side to the paper discharge side. A picture on the upper plate cylinder 15*a* or the lower plate cylinder 15*b* is transferred onto the web 11 via the upper blanket cylinder 17*a* or the lower blanket cylinder 17*b* in the printing unit 5*a*. A fixed scaffold 20 is installed between a frame end 6*a* of the printing unit 5*a* and a frame end 6*b* of the printing unit 5*b* (in FIG. 2) adjacent to the former on the discharge side (hereinafter referred to as fixed scaffold 20) above a travel path of the web 011 in approximately horizontal manner between the printing units. A divided scaffold 30 divided from the fixed scaffold 20 and constructed to be capable of being raised and lowered is provided at an end of the fixed scaffold 20 on the paper feed side.

Between the divided scaffold 30 and the upper and lower plate cylinders 15*a* and 15*b*, upper and lower protectors 21*a* and 21*b* for protecting the inside of the printing unit are provided, and the upper and lower protectors 21*a* and 21*b* are respectively placed at positions "a" for protecting the inside of the printing unit when a usual printing operation is performed, and block off the inside of the printing unit. The upper and lower protectors 21*a* and 21*b* are respectively rotated to positions "b" upon replacing the printing plate so that the same do not disturb the work for replacing the printing plate. Further, an ink mist tray 22 is provided between the upper blanket cylinder 17*a* and the divided scaffold 30.

A supporting structure 40 of the divided scaffold 30 is composed of, as illustrated in FIGS. 3 through 5, attaching tables 41 attached to printing unit frames 23 at both of left and right sides of the printing unit 5*a*, a total of four air cylinders 42, respective two for each of the left and right sides of which are fixed to each of the attaching tables 41 in an up-and-down direction, elevating plates 44 connected to cylinder rods 42*a* of the air cylinders 42 disposed in the up-and-down direction via cylinder rod holders 43, and linear rails 45 attached to the attaching tables 41 in a vertical direction at a position sandwiched between the air cylinders 42.

Besides the supporting structure 40, the divided scaffold 30 is composed of a running board 31 forming a step surface on which the worker rides, a paper pressing roller 34 attached to a lower surface of the running board 31 in a reversibly rotatable manner by means of roller holders 32 and 33, and a linear guide 35 moving in a vertical direction by being guided by means of the linear rail 45, which is attached to the elevating plate 44, and both side edge portions in a web-paper-width direction of the running board 31 is connected to the elevating plate 44 by means of a connecting portion 36.

In the thus constructed present embodiment, in the printing operation, the web 11 travels on a travel path "c" indicated by a solid line from the paper feed side to the paper discharge side in the direction indicated by the arrow "e", and the picture is transferred from the blanket cylinder in a condition that the web 11 is nipped by the upper and lower blanket cylinders 17*a* and 17*b*.

When the printing operation is stopped and the printing plate is replaced, the upper and lower protectors 21*a* and 21*b* disposed in the up-and-down direction are respectively rotated from the position "a" to the position "b". Next, a clearance is formed between the upper and lower plate cylinders 15*a* and 15*b* and the upper and lower blanket cylinders 17*a* and 17*b*, and a nip of the web 11 formed by means of the upper and lower blanket cylinders 17*a* and 17*b* is released.

By releasing the nip formed by means of the upper and lower blanket cylinders 17*a* and 17*b*, the web 11 forms a released web area where there is no nipped portion in the region from the paper feed drag roll 016 in the in-feed section 04 to the cooling cylinder 019 via the plurality of printing units 05*a* through 05*d*, and the dryer section 07, in FIG. 10.

Thereafter, the air cylinders 42 are operated by pressing a switch provided in an operating panel (not illustrated), and a fall of the divided scaffold 30 is started. The running board 31 is gradually lowered and the web 11 is pressed down by means of the paper pressing roller 34 provided at a lower surface of the running board 31. Further, a sag of the web 11 in the region from the paper feed drag roll 016 in the in-feed section 04 to the cooling cylinder 019 in the cooling section 08 is absorbed, while guiding the feeding movement or returning movement of the web 11 in the traveling direction "e" thereof. Thereby, the travel path of the web 11 is moved from a trajectory "c" to a trajectory "d".

Thus, if the running board 31 is gradually lowered by 150 mm, the lowering operation is stopped there. Incidentally, since the running board 31 is lowered while guiding the web 11 by means of the paper pressing roller 34, there is no possibility for the running board 31 to damage or break the web 11. The worker performs the work for replacing the printing plate while climbing up the fixed scaffold 20 via a ladder (illustration is omitted), and riding on the running board 31 of the divided scaffold 30 from the fixed scaffold 20 after lowering down the divided scaffold 30.

If the work for replacing the printing plate of the upper plate cylinder 15*a* is performed in a condition where the divided scaffold 30 is not lowered as in the conventional way, the worker has been obliged to hunker on the running board 31 and to stretch to the distance from a place at a height near a level of a foot. Compared with this, in the present embodiment, since the worker performs the work for replacing the printing plate while riding on the lowered divided scaffold 30, the work is performed at a position higher than the level of the foot and the work for replacing the printing plate of the upper plate cylinder 15*a* can be performed in an extremely easy posture.

Incidentally, it is not necessary for the worker to ride on the fixed scaffold 20 or the divided scaffold 30 to perform the work for replacing the printing plate of the lower plate cylinder 15*b*, and the worker can perform the work in a relatively easy posture while riding on a low step of the printing unit provided on a floor surface.

Furthermore, according to the present embodiment, by concentrating the sag of the released web 11 having no nipped portion in the area between the paper feed drag roll 016 of the in-feed portion 04 and the cooling cylinder 019 of the cooling section 08 into the printing unit where the printing plate is to be replaced, the web 11 can be sagged downward. Hence, a structure for specifically forwarding the web 11 by means of the roll-shaped web offset paper 013 is not required, and the work for replacing the printing plate can easily be performed.

Further, according to the present embodiment, since the paper pressing roller 34 is mounted on a lower surface of the running board 31, an operation for forwarding the web 11 can smoothly be guided even when the web 11 is pressed by the running board 31. Accordingly, there is no possibility to damage the web 11.

EMBODIMENT OF THE SECOND INVENTION

Next, the embodiment of the second invention of the present invention (second embodiment) will be explained on the basis of FIG. 6 through FIG. 9. The present embodiment is an embodiment where the present invention is applied to the variable cutoff rotary press of the web offset press, and in FIGS. 6 through 9 the same numerals are attached to the same elements as that in the embodiment of the aforementioned first invention illustrated in FIGS. 1 through 5, and the explanation thereof is omitted. In FIG. 6 through FIG. 8, a scaffold installed between the frame end 6*a* of the printing unit 5*a* and the frame end 6*b* of the printing unit 5*b* adjacent thereto is constructed with an elevating scaffold 50 where most part in the center except fixed scaffolds 61 and 62 on the front and back sides in the traveling direction of the web 11 is able to be raised and lowered.

Between the fixed scaffold 61 and the upper and lower plate cylinders 15*a* and 15*b*, the upper and lower protectors 21*a* and 21*b* for protecting the inside of the printing unit are provided, and the upper and lower protectors 21*a* and 21*b* are respectively placed at the position a for protecting the inside of the printing unit when a usual printing operation is performed, and block off the inside of the printing unit. The upper and lower protectors 21*a* and 21*b* are rotated to a position b in replacing the printing plate. Further, the ink mist tray 22 is provided between the upper blanket cylinder 17*a* and the fixed scaffold 61.

The elevating scaffold 50 is composed of a horizontally disposed running board 51, and a pair of paper pressing rollers 52 provided at the front and back ends of the running board 51 in the traveling direction of the web 11, and a lower end of the pair of paper pressing roller 52 is positioned lower than a lower surface of the running board 51 so as to guide the web 11 when the elevating scaffold 50 is lowered. Incidentally, the construction of the running board 51 including the pair of paper pressing rollers 52 is identical of the structure in the aforementioned first embodiment illustrated in FIGS. 1 through 5, and in FIGS. 6 through 8 the same is illustrated in a schematic manner compared to that in FIGS. 1 through 5.

Furthermore, guide rollers 63 and 64 are installed on the frame ends 6*a* and 6*b* facing the travel path of the web 11 in the printing units 5*a* and 5*b*, and are configured to guide the web 11 from the fixed sides as well. Incidentally, the guide rollers 63 and 64 are installed at a position slightly lower than a height of the web 11 in printing operation so as for the web 11 not to be in contact with the guide rollers 63 and 64 in the printing operation.

Two brackets 53 are attached to one side end of the lower surface of the running board 51. Moreover, between a step 66 installed between lower steps 65 of the printing units 5*a* and 5*b*, and a supporting plate 67 hung between the printing units located at the same height as that of the fixed scaffolds 61 and 62 in a horizontal direction, two sets of supporting columns 68 and a cylinder 69 for rise-and-fall operation (rod-less cylinder) are provided upright lining in the traveling direction of the web 11. Further, a linear rail 71 is attached to each of the supporting columns 68 in the up-and-down direction, and as illustrated in FIG. 9, a linear guide 54 integrally attached to the bracket 53 is slidably guided by means of the linear rail 71, and an elevating ring 55 integrally connected to the bracket 53 is fitted on the cylinder 69 for the elevating operation in a manner capable of rising and falling. The bracket 53 is constructed so as to be slid up and down by means of the cylinder 69 for the elevating operation via the elevating ring 55. Thereby, the running board 51 is configured to be capable of being raised and lowered in an up-and-down direction together with the bracket 53.

Incidentally, as illustrated in FIGS. 7 and 8, an elevating mechanism of the running board 51, composed of the supporting column 68, the cylinder 69 for elevating operation, and so forth is provided only at one side in the web-paper-width direction thereof. In addition, an air cylinder 56 is attached to each of four corners at a lower surface of the running board 51, and a stopper 56*a* attached to a piston rod of the air cylinder 56 is constructed so as to be projected outside in the paper width direction of the web 11 by means of an operation of the air cylinder 56. Furthermore, a position detecting sensors 72 and 73 for detecting an uppermost rising position and a lowest lowering position of the running board 51 is provided on the supporting column 68.

On the frame ends 6*a* and 6*b* of the uppermost rising position and lowest lowering position, an upper stopper plate 74 and a lower stopper plate 75 are respectively provided, and an upper concave groove 74*a* and a lower concave groove 75*a* to which the stoppers 56*a* are respectively inserted are provided in the stopper plates 74 and 75, respectively. When the running board 51 reaches the uppermost rising position or the lowest lowering position, the position detecting sensor 72 or 73 detects that, operates the air cylinders 56, and projects the stoppers 56*a*. The stopper 56*a* is inserted into the concave groove 74*a* or 75*a*, and thereby the four corners of the running board 51 are fixed to the printing units 50*a* and 5*b* at the uppermost rising position or the lowest lowering position. Incidentally, as for the position detecting sensors 72 and 73, either a contact-type or a noncontact-type is applicable.

In the thus constructed present embodiment, while the web 11 is conveyed from the paper feed side to the paper discharge side (in a direction indicated by an arrow e in FIG. 6 or FIG. 7) and printed in the printing operation, the elevating scaffold

50 is held at a position at the same height as that of the fixed scaffolds 61 and 62 in the printing operation. When the printing plate of the printing unit 5*a* is replaced, the upper and lower protectors 21*a* and 21*b* disposed in the up-and-down direction are rotated from the position a to the position b first. Next, a clearance is opened between the upper and lower plate cylinders 15*a* and 15*b*, and the upper and lower blanket cylinders 17*a* and 17*b*, respectively, and the nip of the web 11 formed by the upper and lower blanket cylinders 17*a* and 17*b* is released.

Thereby, the web 11 in the area from the paper feed drag roll 016 in the in-feed section 04 to the cooling cylinder 019 in the cooling section 08 via the printing units 05*a* through 05*d* in FIG. 10 is formed to be an released web area where there is no nipped portion.

Next, either the tension force of the web 11 is reduced by bringing the dancer roll 014 in the in-feed section 04 closer to the paper feed drag roll 016 side or the sag of the web 11 is produced in the aforementioned area by means of unreeling the web 11 from the roll-shaped web offset paper 013 to the printing section 02 side.

Next, the elevating scaffold 50 is gradually lowered along the linear rail 71 by operating the cylinder 69 for elevating operation by operating a switch, not illustrated. The elevating scaffold 50 is gradually lowered while concentrating the sag of the web 11 in the aforementioned released web area toward the elevating scaffold 50 between the printing units 5*a* and 5*b* by pressing down the web 11 by means of the pair of paper pressing rollers 52 attached to the lower surface of the front and back end of the running board 51.

In this case, the web 11 is guided by means of the pair of paper pressing rollers 52 and the guide rollers 63 and 64. Thereby, as illustrated in FIG. 6, a travel line of the web 11 is moved from a travel path line c in operation to a line d.

Thus, the elevating scaffold 50 is lowered while pressing down the web 11 by means of the pair of paper pressing rollers 52, and the elevating scaffold 50 reaches the lowest lowering position and is stopped. At the same time, the position detecting sensor 73 detects the elevating scaffold 50 and the air cylinder 56 is operated by means of the detecting signal. The stopper 56*a* is thereby projected outward from a side edge of the running board 51 in the paper width direction of the web 11 and is inserted into the concave groove 75*a* of the lower stopper plate 75. Thereby, the elevating scaffold 50 is fixed at this position.

Next, the worker performs work for replacing the printing plate of the upper plate cylinder 15*a* while riding on the running board 51 of the elevating scaffold 50. Incidentally, the work for replacing the printing plate of the lower plate cylinder 15*b* can easily be performed while riding on the lower step 65 of the printing unit even though the worker does not ride on the elevating scaffold 50.

According to the present embodiment, since the elevating scaffold 50 occupying a main part of the scaffold hung between the printing units 5*a* and 5*b* is configured to be capable of being raised and lowered, and the elevating scaffold 50 is lowered to a position close to an upper surface of the step 66, the worker is able to easily ride on the running board 51 of the elevating scaffold 50 without using the ladder.

In addition, since the elevating scaffold 50 occupying the main part of the scaffold hung between the printing units 5*a* and 5*b* is lowered, an area of the running board 51 is relatively wide and the worker can perform the work for replacing the printing plate with ease.

Incidentally, after completing the work for replacing the printing plate, engagement of the upper stopper plate 75 with the lower concave groove 75*a* is released by returning the stopper 56*a* of the air cylinder 56, and the elevating scaffold 50 is raised by operating the cylinder 69 for elevating operation. When the elevating scaffold 50 reaches the uppermost rising position, the position detecting sensor 72 detects this, and thereby the stopper 56*a* is projected outward and inserted into the upper concave groove 74*a* of the upper stopper plate 74. Hence, the elevating scaffold 50 is fixed at the aforementioned uppermost rising position at the same height as that of the fixed scaffolds 61 and 62 above the web 11. An interlock mechanism is constructed to operate such that the printing operation can only be performed if the position detecting sensor 72 has detected the elevating scaffold 50.

Thereafter, the web 11 being sagged is rewound by a rewinding operation of the roll-shaped web offset paper 013 in the paper feed section 03, or the like. In the present embodiment, since it is required to wind off the web 11 in the in-feed section 04 or the paper feed section 03 before performing the work for replacing the printing plate, and is to rewind the web 11 being wound off after completing the work for replacing the printing plate, the present embodiment can only be applied to a web offset press capable of performing this operation. Further, since the winding off operation for the web 11 is performed in the in-feed section 14 or the paper feed section 03, a sufficient sag can be produced on the web 11 and therefore the work for replacing the printing plate can be performed in the plurality of printing units at the same time.

According to the first invention with respect to the method and apparatus for replacing the printing plate in the present invention, since a part of the scaffold on the side where the work for replacing the printing plate is performed is divided and enabled to be raised and lowered, and the divided scaffold is lowered while pressing the web with a lower surface of the scaffold by utilizing a sag of the web produced in an released web area, the divided scaffold can be lowered without damaging or breaking the web, and the worker can perform the work for replacing the printing plate of an upper plate cylinder in an easy posture. Thereby, the printing plate can be attached in an accurate fashion with high dimensional accuracy at a short time.

In addition, since only a part of the scaffold divided is configured to be lowered in a relatively small lowering amount, there is no necessity to produce the sag of the web by feeding the web in the paper feed section or the in-feed section, and since only the sag of the web held in the region from the in-feed section to the dryer section is utilized, it is not necessary to provide an equipment for enabling the web to be fed, as is necessary in the second invention. Hence, the equipment of the web offset press and an operation for replacing the printing plate can be simplified.

According to the second invention with respect to the method and apparatus for replacing the printing plate in the present invention, the scaffold is constructed to be capable of being raised and lowered above the web, and the web is fed in the paper feed section or the in-feed section after enabling the web to be forwarded by forming a clearance between the blanket cylinders that nip the web from both sides in the printing unit. Therefore, the web can sufficiently be sagged at a portion of the elevating scaffold.

Hence, the lowering amount of the scaffold can be increased and the scaffold can be lowered to the vicinity of the lowest end, and in addition the scaffold with a running board having a large area can be lowered. Consequently, the worker can easily ride on the scaffold without using the ladder or the like, and the work for replacing the printing plate can easily be performed by the worker on the scaffold.

Thus, since an amount of the sag of the web can be provided with elbowroom, the scaffold can be lowered to a position where the worker can perform the work for replacing the printing plate in the easy posture without producing an excessive tension force for the web and damaging and breaking the web. Thereby, the worker can perform the work for replacing the printing plate of the upper plate cylinder in the easy posture, and the printing plate can be attached at the short time in the accurate fashion with high dimensional accuracy.

The invention claimed is:

1. A printing plate replacing method in a web offset press for replacing a printing plate wound around a plate cylinder by using a scaffold installed between a plurality of printing units disposed at an interval along a travel path of a web, the method comprising the steps of:

dividing a part of the scaffold on a side where work for replacing the printing plate is performed, and disposing the divided scaffold above the travel path of the web in a manner capable of being raised and lowered;

forming a released web area in a region from an in-feed section to a dryer section via the plurality of printing units by forming a clearance between blanket cylinders nipping the web from both sides in the plurality of printing units;

lowering the divided scaffold to a position adapted for the work for replacing the printing plate of the upper plate cylinder while pressing down the web with a lower surface of the divided scaffold by utilizing a sag of the web in the released web area; and subsequently replacing the printing plate of the upper plate cylinder by using the divided scaffold.

2. The printing plate replacing method in a web offset press according to claim 1, wherein surface finishing or surface treating is performed for the lower surface of the divided scaffold or the scaffold to form a low friction surface.

3. The printing plate replacing method in a web offset press according to claim 1, wherein the web is pressed down with the lower surface of the scaffold while guiding the web in a traveling direction thereof by means of a guide device provided at a lower part of the divided scaffold or the scaffold.

4. A printing plate replacing method in a web offset press for replacing a printing plate wound around a plate cylinder by using a scaffold installed between a plurality of printing units disposed at an interval along a travel path of a web, the method comprising the steps of:

disposing the scaffold above the travel path of the web in a manner capable of being raised and lowered;

forming a released web area in a region from an in-feed section to a dryer section via the plurality of printing units by forming a clearance between blanket cylinders nipping the web from both sides in the printing units;

producing a sag of the web in a region from the in-feed section to the dryer section via the plurality of printing units by feeding the web in a paper feed section or the in-feed section;

lowering the scaffold to a vicinity of a lowest position while pressing down the web with a lower surface of the scaffold by utilizing the sag of the web; and subsequently replacing the printing plate of the upper plate cylinder by using the scaffold thereafter.

5. A printing plate replacing apparatus in a web offset press for installing a scaffold between a plurality of printing units disposed at an interval along a travel path of a web and replacing a printing plate wound around a plate cylinder by using the scaffold, the apparatus comprising:

the scaffold being disposed above the travel path of the web, and a part of the scaffold on a side where work for replacing the printing plate is performed being divided and constructed to be capable of being raised and lowered in an up-and-down direction:

means for forming a released web area in a region from an in-feed section to a dryer section via the plurality of printing units by forming a clearance between blanket cylinders nipping the web from both sides in the printing unit; and means for lowering the divided scaffold while pressing down the web with a lower surface of the divided scaffold by utilizing a sag of the web in the released web area upon replacing the printing plate, and for raising the scaffold to a former position after completing the work for replacing the printing plate.

6. The printing plate replacing apparatus in a web offset press according to claim 5, wherein guide means for guiding the web in a traveling direction is provided below the divided scaffold or the scaffold.

7. The printing plate replacing apparatus in a web offset press according to claim 5, wherein the divided scaffold or the scaffold is attached to a linear guide rising and falling along a linear rail provided on a fixed portion in an up-and-down direction, and is constructed to be capable of being raised and lowered by means of an air cylinder provided on the fixed portion.

8. A printing plate replacing apparatus in a web offset press for installing a scaffold between a plurality of printing units disposed at an interval along a travel path of a web and replacing a printing plate wound around a plate cylinder by using the scaffold, the apparatus comprising:

the scaffold being disposed above the travel path of the web in a manner capable of being raised and lowered;

means for forming a released web area in a region from an in-feed section to a dryer section via the plurality of printing units by forming a clearance between blanket cylinders nipping the web from both sides in the printing unit;

means for reducing a tension of the web for producing a sag of the web in the released web area by feeding the web in a paper feed section or the in-feed section; and means for lowering the scaffold while pressing down the web with a lower surface of the scaffold by utilizing a sag of the web upon replacing the printing plate, and for raising the scaffold to a former position after completing the work for replacing the printing plate.

9. A web offset press comprising the printing plate replacing apparatus according to claim 5.

* * * * *